United States Patent [19]

Roy et al.

[11] Patent Number: 4,785,746

[45] Date of Patent: Nov. 22, 1988

[54] CARBONACEOUS SLURRY COMBUSTOR

[75] Inventors: Gabriel D. Roy; Douglas B. Sheppard, both of Torrance, Calif.

[73] Assignee: TRW Inc., Redondo Beach, Calif.

[21] Appl. No.: 891,975

[22] Filed: Aug. 1, 1986

Related U.S. Application Data

[63] Continuation-in-part of Ser. No. 726,859, Apr. 25, 1985, abandoned, which is a continuation of Ser. No. 670,412, Nov. 13, 1984, abandoned.

[51] Int. Cl.[4] ..... F23D 1/00

[52] U.S. Cl. ..... 110/347; 110/238; 110/265; 110/262; 431/10; 431/284

[58] Field of Search ..... 110/260–266, 110/347, 238; 239/132.3, 426; 431/10, 284

[56] References Cited

U.S. PATENT DOCUMENTS

| | | | |
|---|---|---|---|
| 1,614,314 | 1/1927 | Murray et al. | 110/265 |
| 2,702,743 | 2/1955 | Totzek | 110/264 |
| 2,971,480 | 2/1961 | Sage | 110/265 |
| 3,229,651 | 1/1966 | Wasp | 110/262 |
| 3,787,168 | 1/1974 | Koppang et al. | 239/425 |
| 3,822,654 | 7/1974 | Ghelfi | 110/238 |
| 3,830,172 | 8/1974 | Hindenlang | 110/238 |
| 4,094,625 | 6/1978 | Wang et al. | 110/238 |
| 4,412,808 | 11/1983 | Sheppard et al. | 431/284 |
| 4,466,363 | 8/1984 | Leikert et al. | 110/347 |
| 4,505,665 | 3/1985 | Mansour | 431/10 |
| 4,512,267 | 4/1985 | Cegielski, Jr. et al. | 110/265 |
| 4,599,955 | 7/1986 | Hepworth et al. | 110/347 |

*Primary Examiner*—Henry C. Yuen

*Attorney, Agent, or Firm*—Shlomo R. Frieman; Benjamin DeWitt

[57] ABSTRACT

Disclosed is an apparatus for introducing slurry fuels into the combustion zone of high power density combustors, boilers, industrial furnaces or steam generators. Having the general form of an elongate cylinder, the apparatus comprises a central conduit for a flow of particulate carbonaceous fuel suspended in a carrier liquid, and separate annular passageways for an atomizing fluid and a coolant. The slurry flows longitudinally to about the position where it is to be dispersed into the combustion zone, is there divided into a plurality of streams that are deflected to flow individually through a corresponding plurality of radially extending passages and slurry portholes spaced apart around the periphery of the cylindrical structure. Just before these streams leave the injector they are each impinged by a higher-velocity longitudinal flow of atomizing fluid which breaks the filaments of viscous slurry into minute droplets. Each droplet consists of particles of carbonaceous fuel suspended in liquid and is small enough to be heated and ignited closely adjacent the periphery of the injector.

7 Claims, 6 Drawing Sheets

SLURRY
10
12
14
16
18
26
28
30
34
36
38
40
42
44
48
50
52

CARBONACEOUS SLURRY COMBUSTOR

CROSS-REFERENCE TO RELATED APPLICATION

This application is a continuation-in-part of application Ser. No. 06/726,859 filed Apr. 25, 1985 now abandoned which is a continuation of Ser. No. 06/670,412 filed Nov. 13, 1984, now abandoned.

BACKGROUND OF THE INVENTION

For multi-million-Btu thermal energy facilities such as electric-power plant boilers and industrial furnaces, an attractive fuel is carbonaceous material suspended in a liquid slurry and, therefore, transportable through pipelines and by transport methods similar to those used for conveying fuel oil. The carbonaceous fuel material may be solid or liquid, but is dispersed in a liquid carrier. A typical slurry is a coal/water slurry. In this medium, coal can be transported and combusted with minimum material-handling and operational problems. Combustion of slurry, however, poses different problems as compared to the combustion of pulverized coal, oil or other discrete, carbonceous materials in a gaseous medium. Performance depends on how well and quickly the slurry is atomized, mixed with oxidant and heated to ignition temperature.

In high power density slagging combustion systems, such as that described in copending patent application Ser. No. 670,417 filed Nov. 13, 1984, now abandoned, a primary requirement is immediate ignition and stable combustion of particulate fuel, in a stable flame pattern, within a few milliseconds after the fuel enters the combustion chamber and closely adjacent the point where the fuel issues from the fuel injector. In such systems, as well as in conventional boilers and industrial furnaces, a need has existed for improved fuel-injection subsystems, capable of handling and injecting coal-water slurries in a manner such that ignition and combustion of the carbon content of the fuel occurs immediately, consistently and with maximum flame stability. These criteria require extreme comminution of the slurry into the smallest possible droplets and intimate mixing of the droplets with high temperature oxidant as promptly as possible after they enter the combustion chamber.

The present invention is particularly useful in the high power density, slagging combustion systems referred to above. However, its applicability is not so limited; it may be used to considerable advantage for the combustion of liquid slurries of solid carbonaceous fuel in substantially any apparatus, boiler, furnace or facility where it is desired to transport particulate fuel carried in a pumpable liquid from a fuel source or depot to the fuel combustion and heat utilization equipment.

SUMMARY OF THE INVENTION

There is provided in accordance with the present invention an apparatus for injection of slurries that include a particulate carbonaceous material, such as powdered coal. In one embodiment, the apparatus comprises an elongate slurry transport conduit having an axis which terminates in an axially oriented conical divider. A plurality of channels arranged about said divider receive slurry flow diverted by said conical divider to the channels. Each of a corresponding plurality of first slurry flow ports has an inlet in flow communication with a channel, and an exit which is aligned with one of a plurality of second flow ports, radially spaced from the aligned first ports. Flow between these aligned ports preferably is at an angle in the range from 45° to 90° relative to the longitudinal axis of the slurryinflow conduit. An atomizing flow conduit, annularly positioned with respect to said slurry transport conduit, intersects the space between aligned first and second slurry flow ports to intersect the slurry flow. Compressed gas, flowing through the atomizing flow conduit intercepts filaments of viscous slurry intermediate the first and second flow ports breaking these filaments into minute droplets, which are thereby dispersed into and intimately mixed with oxidant (e.g. heated air) in the combustion space peripherally adjacent the second flow ports.

In the presently preferred nozzle, there is utilized low velocity slurry flow up to the point of interception by atomizing gas, which features a reduction in the amount of atomizing gas required to achieve the break-up of the slurry into particles. In the nozzle, the slurry is intercepted by the atomizing gas in the form of an annulus. The slurry is an annular low velocity conically diverging flow stream extending by flow about a bend at some angle to the axis of the injector. The conical annular flowing slurry is intercepted by an annular flow of compressed atomizing gas which mixes with the diverging conical annulus of slurry. The two mix and form, by energy transfer, droplets of slurry which are ejected and intercepted by the surrounding oxidant introduced to the combustion process.

The injectors are particularly useful in slagging combustors for combustion of particulate carbonaceous material in a high-velocity whirling flow of preheated oxidant mixed with minute fuel particles and gaseous combustion products, including droplets of molten slag.

DETAILED DESCRIPTION

The present invention relates to improvements in methods and apparatus for efficiently combusting particulate carbonaceous materials. Basic to the system is the use of combustion methods and several subsystems which, in cooperation, enable slurried fuel materials to be combined with preheated oxidant, typically air, under conditions where essentiallyspontaneous ignition occurs and combustion continues in fluid dynamic flow fields.

As explained in greater detail hereinafter, the present invention resides in improvements in the combustion of slurries of particulate fuel and, more specifically, in an improved method of and apparatus for injection and dispersion of such slurries into a combustion zone having a flow of heated oxidant provided for oxidation of the fuel.

A. THE SLAGGING COMBUSTION SYSTEM

Figure 1:
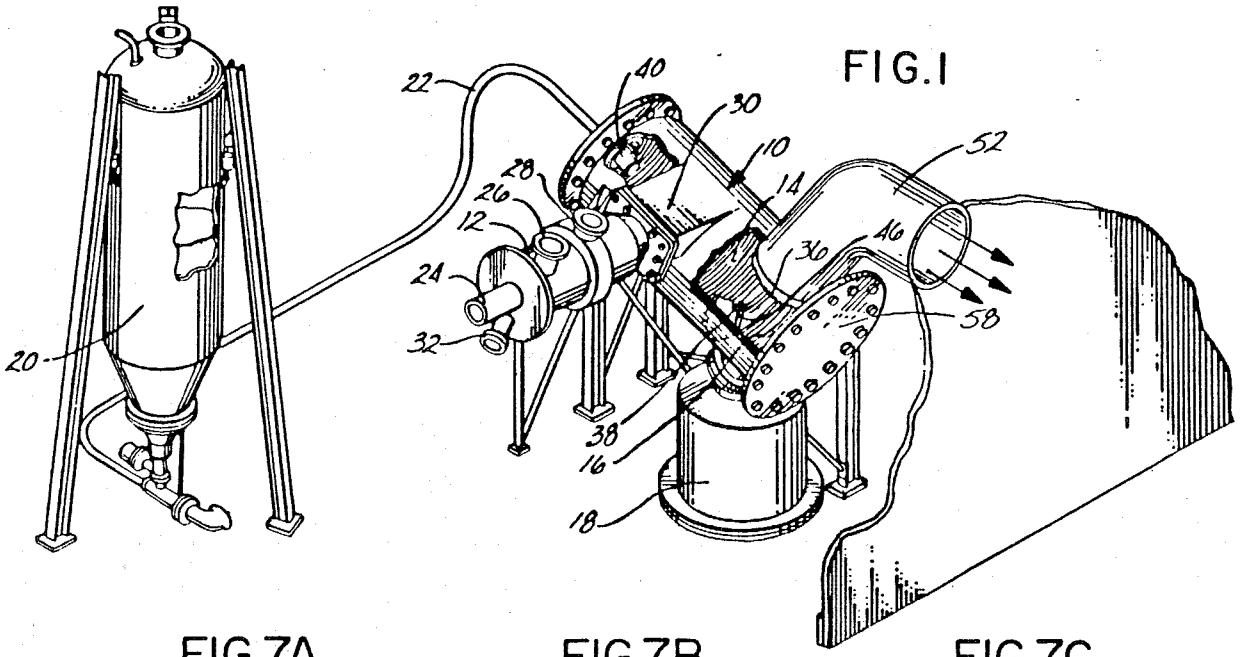
FIG. 1 is a perspective arrangement of a slagging combustion system in which the apparatus of the present invention is particularly useful and beneficial.
Figure 2:
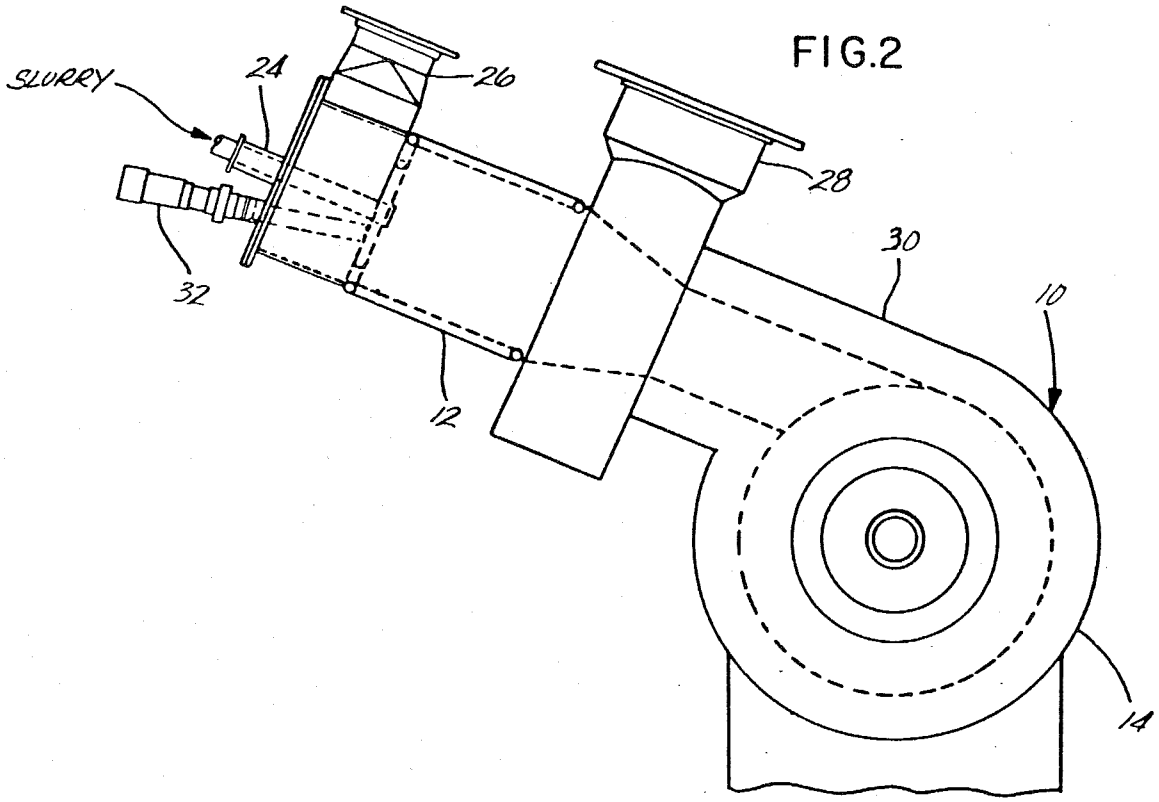
FIG. 2 illustrates the precombustor of the slagging combustion system.
Figure 3:
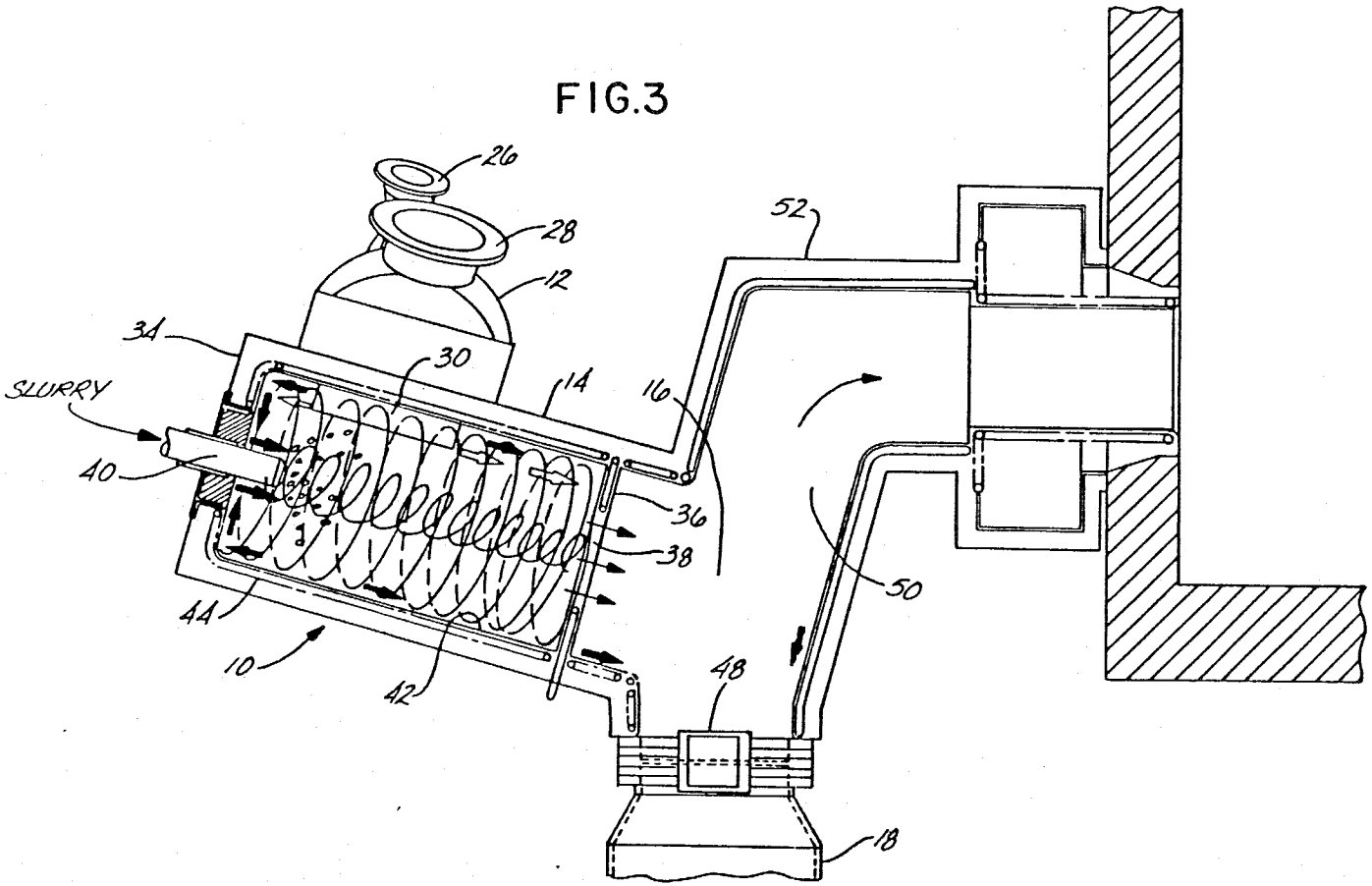
FIG. 3 illustrates a combustion chamber in which the instant invention is advantageously used, together with associated apparatus for collecting molten slag and conducting gaseous products to an end-use equipment.

With reference first to FIGS. 1, 2, and 3 the slagging combustion system 10 comprises a precombustion chamber 12, primary combustion chamber 14, and slag-recovery chamber 16 with which slag collection unit 18 is associated. As shown in FIG. 1, the bulk of the particulate carbonaceous fuel to be consumed is supplied from reservoir 20 by line 22 to primary combustion chamber 14. The balance, usually from about 10% to about 25% of the total feed, is fed to precombustion chamber 12.

The presently preferred structures for the three chambers 12, 14 and 16 are detailed with particular reference to FIGS. 2 and 3.

The function of chamber 12 is to condition the oxidant, normally air, for feed to primary combustion chamber 14, where the primary feed of particulate carbonaceous material is combusted under substoichiometric, slag-forming conditions.

By the term "particulate carbonaceous material" as used herein, there is meant carbon-containing substances which can be provided as a fuel source in a dispersed fluid. Representative carbonaceous materials include, among others, coal, char, the organic residue of solidwaste recovery operations, tarry oils which are dispersible in a carrier fluid which can be a gas or a liquid. Essentially, all that is required is that the carbonaceous material to be used be amenable to fluidized transport in a carrier fluid, which may be a liquid or a carrier gas, e.g. air. The most typical form in which the carbonaceous material is provided is that of coal, and the invention will be described in detail in terms of the combustion of coal.

By the term "oxidant" as used herein, there is meant a gaseous source of oxygen, preferably air or oxygen-enriched air.

Preconditioning of the oxidant is achieved in precombustion chamber 12, ideally of cylindrical geometry, to which first-stage oxidant is fed by way of inlet 26 to combine with that portion of the particulate fuel being fed to the precombustion chamber through nozzle assembly 24. The fuel introduced to nozzle assembly 24 and the oxidant, in an amount required for substantially stoichiometric conversion of the fuel introduced by nozzle assembly 24, are reacted to yield a gas of high temperature, e.g. about 3000° F. or more.

A second portion of the oxidant feed to the precombustor is introduced through concentric plenum conduits 28 of precombustor 12. The oxidant mixes with the reaction products. This produces a hot (from about 1200° to 1800° F.) oxidant-rich gas stream which is directed through a rectangular exit conduit 30.

The heated oxidant and reaction products generated in the precombustion chamber 12, move through exit 30 tangentially into primary combustor 14, which is preferably of cylindrical geometry. The oxidant and reaction products from the precombustor 12 not only cause a whirling motion of the flow field within primary chamber 14, but, as shown in FIG. 3, the oxidant and reaction products flowing from the precombustor apparatus divide into two substantially high-velocity streams, with one stream flowing spirally along the wall towards head end 34 of primary combustor 14, and the other whirling in a high velocity helical path along the wall of the primary combustor toward apertured baffle 36. The first stream is turned inward at head end 34, and flows helically back toward the apertured baffle 36. This baffle 36 of the primary combustor is a fluid-cooled plate located perpendicular to the centerline of the primary combustor and having a generally centrally-located aperture 38, with the diameter of the aperture being at least about 50% of the internal diameter of the primary combustor.

As noted hereinabove, a major part of the carbonaceous fuel is introduced into primary combustor 14 at head end 34, through centrally-located fuel injector 40, which is positioned substantially along the centerline of primary combustor 14. Fuel injector 40, described in detail below, sprays the carbonaceous fuel into the generally whirling gas flow field, at a net angle of from about 45 degrees to about 90 degrees with respect to the centerline of chamber 14. The nozzle 40 protrudes into primary combustor 14 from head end 34 to a point slightly upstream of the head-end edge of precombustor exit 30.

That portion of the precombustor oxidant and reaction product which flows towards head end 34 of primary combustor 14 provides an initial ignition and fuel-rich reaction zone. As illustrated in FIG. 3, the whirling flow field, as well as the conical injection pattern, causes the now-burning fuel to move in a generally outward path towards the wall of chamber 14. The bulk of the combustibles is consumed in flight through the heated oxidant flow field, giving up energy in the form of heat of reaction and further heating the resultant reaction products and local residual oxidant. The solid carbonaceous particles in free flight are also given an axial component of motion towards the exit of primary combustor 14, such axial motion being imparted by the return axial flow of the head-end oxidant. In operation, essentially all of the carbon contained in the fuel is converted, in flight, to oxides of carbon before the fuel particles reach the walls or exit from chamber 14. Little unburned carbon reaches the chamber's walls; and, therefore, the system tends to maintain a relatively oxygen-rich annular zone adjacent the cylindrical walls. The whirling flow field centrifugally carries the molten noncombustibles, i.e. slag, to the wall of the primary combustor.

Fuel-rich gases generated in the head end of the primary combustor generally flow toward exit baffle 36 of the primary combustor while the whirling motion is maintained and mixed with oxidant entering from conduit 30. Typical bulk, average, axial-flow velocities are from about 80 to about 100 fps. The internal flow, mixing, and reaction are further enhanced in chamber 14 by a strong recirculation flow along the centerline of primary combustor 14, the flow moving from the center of the baffle aperture 38 towards head end 34 of primary combustor 14, and forming a fuelrich core portion in the combustion zone, peripherally surrounded by the relatively oxygen-rich annular zone, described above. This core-portion flow is controlled by the precombustor exit flow velocity and selection of the diameter of central aperture 38. Preferably, precombustor exit velocity is about 330 fps, and a preferred baffle-opening-diameter to primary-chamber-diameter ratio of approximately 0.5 produces ideal secondary recirculation flows for enhanced control of ignition and overall combustion within primary chamber 14.

As indicated, the stoichiometry of the primary combustor is selected to be from about 0.7 to about 0.9, preferably from about 0.7 to about 0.8. With the stoichiometry maintained within these ranges, the fuel-rich hot gases are sufficiently hot to produce molten slag at a temperature sufficiently above the slag's fusion temperature so that the slag will flow freely along the walls of primary combustor 14. The temperature is not so high, however, that significant amounts of slag would be vaporized and carried out as a vapor component of the gaseous product.

The internal primary combustor slag-flow pattern is driven by the aerodynamic shear forces of the whirling and axial flow gases, and gravity. By tilting the primary combustor at an angle of approximately 15° with respect to horizontal, a satisfactory slag flow occurs within the primary reactor 14, and the molten slag flows out of chamber 14, by way of a keyhole-like aperture in exit baffle 36, to slag-recovery plenum 16 and, thence, to the slag collection and disposal subsystem 18.

Providing a primary combustor length-to-diameter ratio of, nominally, 1.5:1 to 2:1; a baffle diameter-to-primary chamber-diameter ratio of 0.5 to 1.0; and with essentially full, free-flight burning of, nominally, 80% smaller than 200-mesh coals slurried in water, as described herein, substantially no unburned carbon is carried out in the gaseous product. Further, excellent wall-slag-layer flow and heat-transfer protection are achieved.

From primary combustor 14, the gaseous reaction products flow into slag-recovery plenum 16, with which is associated slag-recovery system 18. At the bottom of chamber 16 is slag-tapping aperture 48 and at its top is an aperture 50, with a transition flow passage arranged at substantially a 90° angle with respect to the centerline of chamber 16. From this aperture at the top of chamber 16 extends exit duct 52 to carry the fuel-rich gases on to their ultimate use. This duct leaves chamber 16 on an angle close to vertical, and normally extends for approximately one to two length-to-diameter ratios, one having been found to be adequate, before turning the exit gas flow horizontally towards its ultimate use.

The body of gaseous combustion products in slag-recovery chamber 16 provides the source of the hot recirculation gases which flow up the centerline of the primary combustor 14 into the core portion of the primary combustion zone. The diameter of this core portion is on the order of from 70% to 75% of the diameter of aperture 38 of the baffle plate.

The remainder, and major part, of the carbonaceous fuel is introduced into primary combustor 14 at head end 34, through centrally-located slurry injector 40 which is inserted along the centerline of primary combustor 14. The centrally-located slurry injector 40, described in detail below, causes the slurry to be introduced in a substantially conical flow pattern, into the gas flow field at a net angle of from about 45 degrees to about 90 degrees with respect to the centerline of chamber 14. Slurry injector 40 protrudes into primary combustor 14 from head end 34 to a point upstream of the edge of precombustor exit 40, where it injects the particulate carbonaceous fuel slurry into the primary combustor. Preferably, the injector is designed to maintain a hot external surface to further enhance headend ignition and combustion at the point of fuel injection and atomization.

The portion of the precombustor oxidant and reaction product which flows towards head end 34 of primary combustor 14, further provides an initial ignition and fuel-rich reaction zone, with an overall head-end stoichiometry of from about 0.4 to about 0.5. As illustrated in FIG. 3, the whirling flow field, as well as the conical injection pattern, causes the burning fuel to move in a generally outward path toward the side walls of chamber 14. The bulk of the combustibles are consumed in flight through the heated oxidant flow field, giving up energy in the form of heat of reaction and further heating the resultant reaction products and local residual oxidant. The solid carbonaceous particles, initially suspended in droplets, in free flight also are given an axial component of motion towards the exit of primary combustor 14, such axial motion being imparted by the return swirling flow of the head-end oxidant. In operation, essentially all of the carbon contained in the fuel is converted to oxides of carbon while the particles are in flight and before the resulting slag droplets reach the walls of the chamber. Any unconsumed carbon reaches the wall of the combustor as a combustible char, which continues to be consumed on wall 42. The whirling flow field centrifugally carries the molten noncombustibles, i.e. slag, to the walls of the primary chamber 14.

The slagging combustion system as generally described in the foregoing paragraphs is more specifically described, with emphasis given to the details of several other aspects and features, in copending patent applications Ser. No. 670,417, now abandoned, and Ser. No. 670,416, U.S. Pat. No. 4,660,478 both filed Nov. 13, 1984, and assigned to the same assignee as the present invention. The above-identified applications are hereby incorporated by reference. For a more complete understanding of the present invention and various structural aspects and features of the combustion process and apparatus, one may find it useful to refer to those applications.

B. CARBONACEOUS SLURRY ATOMIZATION AND COMBUSTION

With reference now to FIGS. 4, 4A, 5, 5A, 6, 6A, 7A, 7B, 7C, 8 and 8A, there is provided, for use in a slagging combustor system as described above, a particulate-carbonaceousmaterial liquid slurry injector 54 for use with injector assemblies 40 and/or 24, which introduce such a fuel in a minutely atomized state. Its maintenance of combustion close to the point of injection of the slurry into the combustion zone, is predicated on the use of an atomizing gas, such as air or a vapor, which intercepts the slurry in a direction angular to the direction of slurry flow, and mixes with and atomizes the slurry to achieve rapid dispersion and expansion of atomized droplets immediately upon ejection from the slurry injector 54. While the apparatus is illustrated in FIGS. 4, 4A, 5 and 5A as ejecting the slurry fuel perpendicularly from the axis, and at about 60° in FIGS. 6 and 6A, it is to be understood that the fuel may be sprayed either radially or in a conical pattern at any angle from the axis ranging from about 45° to 90°. This promotes rapid ignition of the slurry droplets immediately as they leave the injector 54 and thereby assures stable, reliable combustion closely adjacent the slurry injector. The slurry injector 54 finds utility with mixtures of coal dispersed in water and/or oil, oil dispersed in water, or other non-solid fuel materials, and any solids/liquid slurry where atomization is necessary. The injectors of FIGS.

Figure 6:
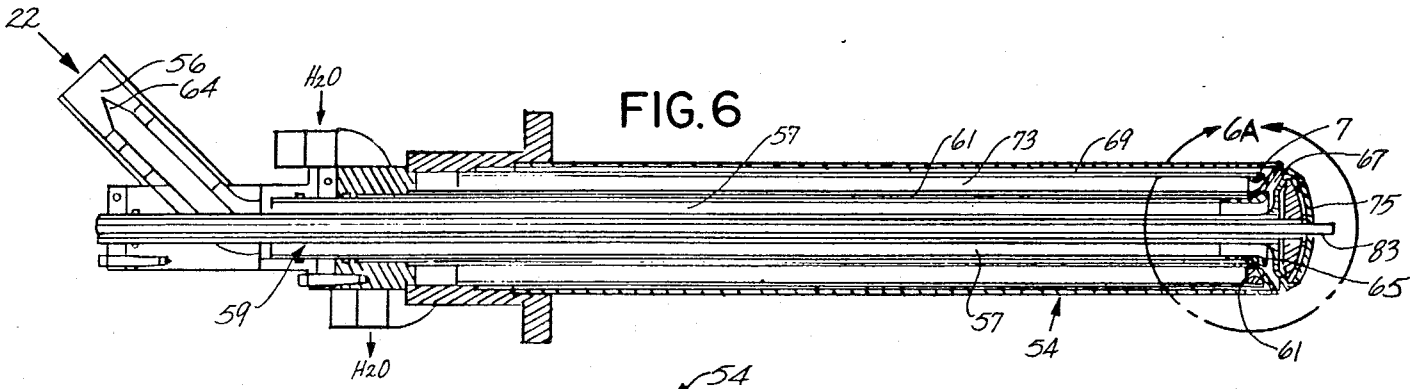
Figure 6A:
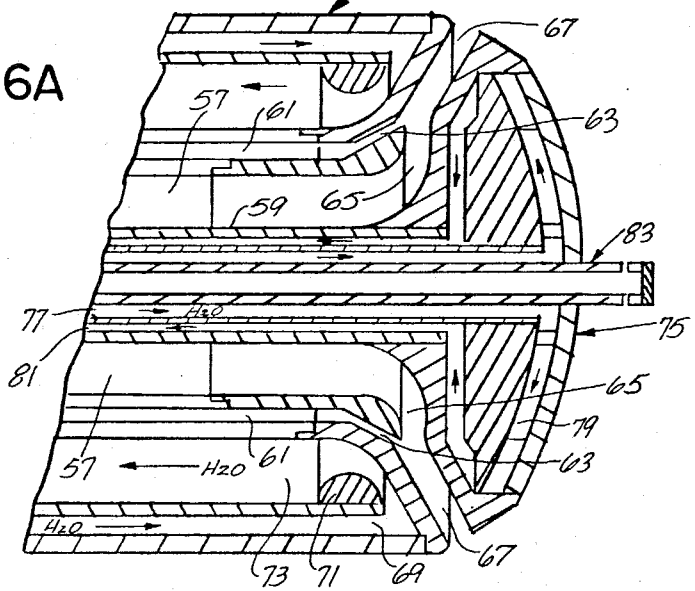

4, 4A, 5 and 5A utilize high velocity flow internal of the injector because parts employed are more susceptible to wear and plugging if high solid fuels are employed. The injector of FIGS. 6 and 6A is adapted to low internal flow velocities and particularly suited to solid containing fuels.

With reference to FIGS. 4, 4A, 5 and 5A, the coal/water atomizer 54 forms part of injection assembly 40 (FIG. 3). FIGS. 4, 4A, 5, and 5A illustrate atomizer 54 for two different-sized feed capacities. The atomizer of FIGS. 5 and 5A has approximately twice the effective diameter of that in FIGS. 4 and 4A, and carries many more ports of comparable size. It has approximately ten times the fuelflow capacity and, therefore, approximately ten times the BTU rating of the injector shown in FIG. 4.

As to each, the slurry is introduced to the nozzle in conduit 56 along an axis substantially normal to the direction of ejection from nozzle 54. Atomizing fluid, normally an oxidizer such as compressed air introduced by conduit 58, intersects the slurry at the juncture of communicating ports 60 and 62 in a direction substantially normal to the point of travel of the slurry from ports 60 and 62, and causes shear and atomization of the slurry as it flows into primary combustor 14.

More particularly, a slurry is introduced from line 22 to conduit 56 and is diverted by cone-shaped projection 64 to a plurality of conduits 66 which results, at ports 60, in the direction of the slurry being changed to an angle substantially normal to the flow of the slurry in conduit 66. The slurry is met at ports 60 by a flow of the atomizing fluid, e.g. air, flowing inwardly through conduit 58. The gas shears and atomizes the slurry, which causes expansion, and the slurry is delivered to radial ejector ports 62, located about the periphery of atomizer 54 in line with ports 60. Ejector ports 62 are preferably slightly divergent in the direction of flow, optimally at an angle of divergence of about 5 degrees.

With reference to FIGS. 6 and 6A, there is shown the preferred nozzle configuration for slurry injection. Low velocity plug flow is utilized up to the point of atomization. The slurry is introduced to the nozzle 54 in annular conduit 57 defined by central core 59. Atomizing fluid, normally an oxidizer such as compressed air, is introduced by annular conduit 61, exits diverging conduit 63 and intersects the slurry after it changes direction at bend 65 to form a divergent annular cone at some angle, preferably between 60° or less to the axis of nozzle 54 and causes shear and atomization of the slurry as it flows through mixing annulus 67 into precombustion chamber 12 or primary combustor chamber 14.

More particularly, a slurry is introduced from line 22 to conduit 56 and is diverted by cone-shaped projection 64 to low velocity free flow annular conduit 57. When slurry flow reaches annular divergent turn or bend 65, the slurry changes its direction of flow to one at an angle divergent to the flow of the slurry in conduit 57. The slurry is met at the junction of conduit 63 by a flow of the atomizing fluid, e.g. air, flowing through conduit 61. The gas shears and atomizes the slurry in annular mixing conduit 67 with expansion, and the slurry is delivered in droplets in a conical fashion from the periphery of atomizer 54 into the combustion zone.

Figure 4A:
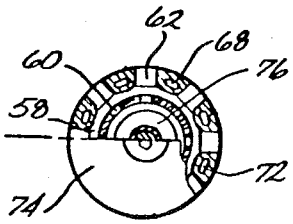
FIGS. 4, 4A, 5, 5A, 6 and 6A illustrate slurry injectors for use in accordance with the present invention with the slurry injector shown in FIGS. 6 and 6A being presently preferred.
Figure 4:
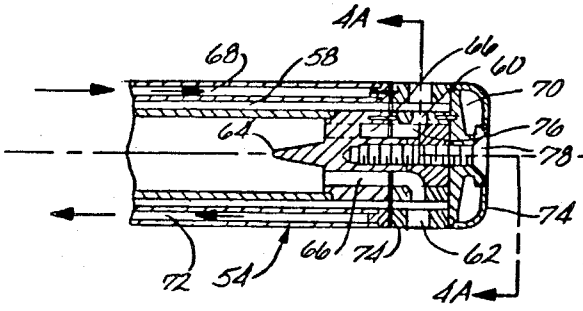
Figure 5A:
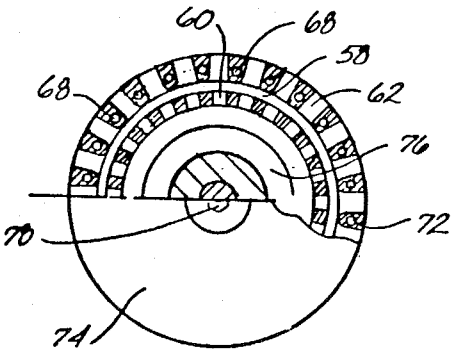
Figure 5:
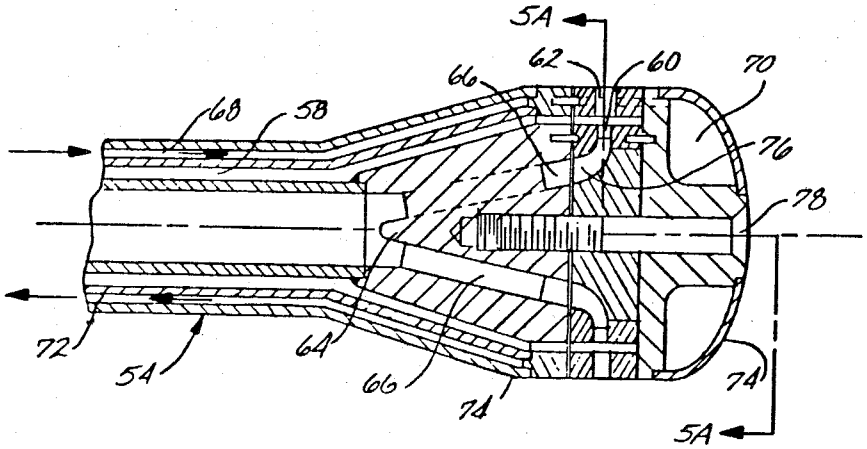

In the operation of the injector shown in FIGS. 6 and 6A, the slurry flows through conduit 57 at a substantially lower velocity than through the ports of the injector depicted in FIGS. 4 and 5. A high velocity annulus of atomizing gas intercepts the slurry as it turns the bend 65 and breaks up the annular flow into minute droplets suitable for combustion and is accelerated into the combustion zone with attendant transfer of kinetic energy from the atomizing gas to the slurry droplets. This enables essentially a low velocity free flow through annular conduit 57 relying on the transfer of energy from the high velocity flow of atomizing air at the end to achieve droplet formation. As compared to the conduits depicted in FIGS. 4 and 5, the mass of air to the mass of slurry required to achieve atomization can be reduced by at least 50% to a ratio of air to particulate solids from a value of about 0.3 now down to about 0.15. The length of the core 59 is not critical to functional operation of the injector but minimizes the volume of lurry to be purged at termination of combustion.

Figure 7C:
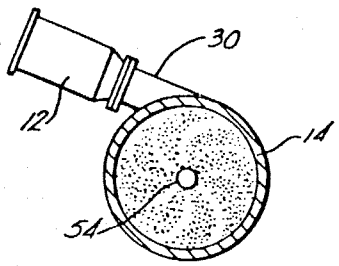
FIGS. 7A, 7B, and 7C show the cooperative interaction between the operation of a slurry injector and swirling flows of oxidant adjacent thereto.
Figure 7B:
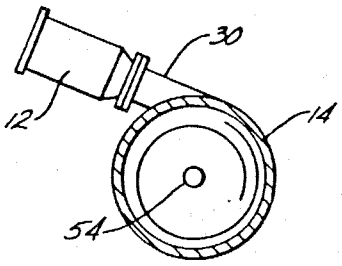
Figure 7A:
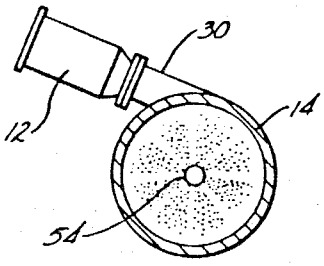

FIGS. 7A, 7B, and 7C illustrate the cooperative action of the atomized fuel and the surrounding heated and swirling oxidant, typically air mixed with gaseous products of combustion and droplets of molten slag. FIG. 7A shows the effect of the atomizer itself. The atomizing gas causes the coal/water particles to expand as droplets of coal in the carrier fluid, e.g. water, in expanding cones. The flow of heated oxidant tangentially introduced from precombustor 12, is depicted in FIG. 7B. The combination of the two is depicted in FIG. 7C. The mixing of oxidant with the cones of atomized slurry results in the formation of an intimate mixture of rotating droplets of fuel and carrier fluid, atomizing gas, and oxidant, in a tangential swirl as a consequence of the swirling oxidant mixing with the atomized cones. Combustion of the carbonaceous droplets is initiated, and forms a stable flame closely adjacent the periphery of the injector. Using orifices of sufficiently large diameter or preferably the portless ejector of FIGS. 6 and 6A allows continuous flow to be maintained without plugging. Generally, radial injection maximizes the residence time in the combustion zone. The emergent particles are initially ejected in a radial direction. This radial path is turned in a direction normal thereto, insuring increased particle flight time in the slagging combustor and affording a greater opportunity to achieve the combustion of coal particles to zero carbon content before the particles reach the walls of chamber 14 or exit from the combustion chamber. The swirling flow of oxidant provides secondary mixing and recirculation which, in combination with the heat radiated from the walls of the slagging coal combustor, causes even further expansion and separtion of particles into discrete coal droplets, thereby accelerating combustion.

Returning now to FIGS. 4, 5, 6 and 6A, the injectors are cooled by fluid flow (e.g. water), thereby avoiding overheating and possible agglutination of the slurry-fuel as it flows through the injector. Annular cooling chamber 68 of the injectors is divided into a pair of semi-annular conduits by means of a metallic barrier lying in the horizontal plane (FIG. 5) and extending across annular cooling chamber 68 at both sides of the injector. Thus, the annular chamber forms two longitudinally extending fluid conduits 68 and 72. Coolant flows into and forwardly along the top conduit 68 to plenum 70. Outflow from plenum 70 is by way of the lower semi-annular conduit 72.

In the head end of the slagging combustion system the injector 54 (shown as element 40 in FIG. 3) is immersed in a turbulent, whirling mixture of oxidant and gaseous products of combustion having temperatures commonly exceeding 2000° F. This mixture delivers an extreme flux of radiant heat to surfaces 74 of the injector. Thus it is only by the provision of coolant flowing through the injection assembly, peripherally outside the slurry conduit 56, that degradation of the fuel and agglomerate plugging is avoided.

The injector 54 of FIGS. 6 and 6A is cooled by fluid flow (e.g. water), entering annular conduit 69 used to feed water which passes over wier 71 and returns by conduit 73 to a provided outlet. The head 75 of injector 54 is cooled by flow of a coolant into conduit 77 into manifold 79 of head 75 and exits by conduit 81. Head 75 is secured to core 59 which houses conduits 77 and 81.

It may also contain oil ignitor 83 which ejects oil normal to the axis of the injection during start-up and may be utilized for injectors of precombustor 12.

Figure 8A:
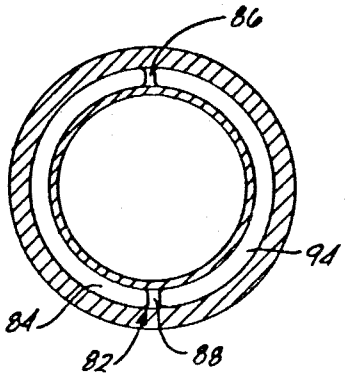
FIG. 8A is a cross-sectional view of the cooled sleeve of FIG. 8.
Figure 8:
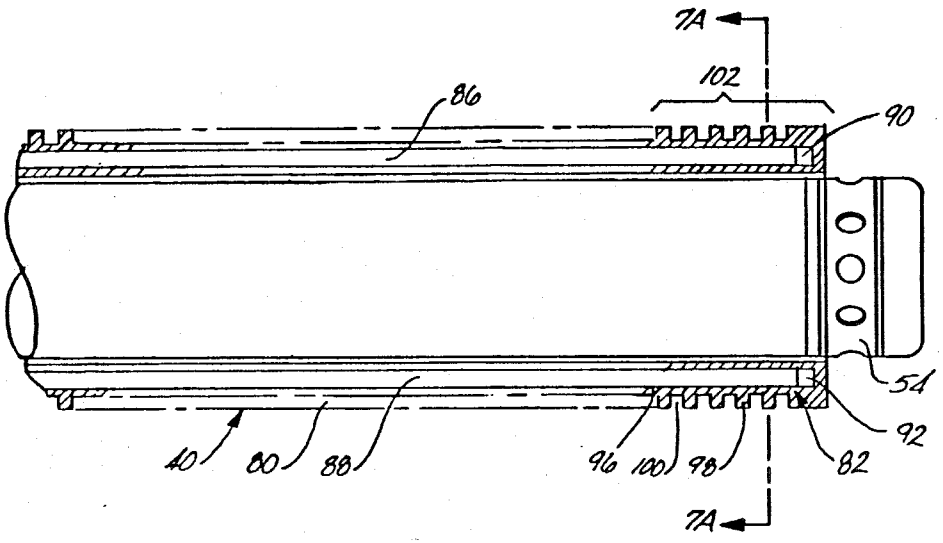
FIG. 8 illustrates the detail of a fluid cooled sleeve used with the injectors of the invention.

As shown in FIGS. 8 and 8A, the sleeve which enters into the end of the primary combustion chamber includes a liquid-cooled jacket 82, where a liquid such as water flows in one side 84 of jacket 82, through a channel formed by dividing walls 86 and 88, through annular plenum 90, and then out the opposed-side channel 94, on the opposite-side of dividing walls 86 and 88. Suitable conduits (not shown) provide for supply and return of coolant to and from jacket 82 from external the primary combustor 14.

Extending from the outer wall 96 are a plurality of radial fins 98 which form between them a plurality of grooves 100. Slag forming along the end wall of primary combustor will flow out along nozzle assembly filling up and then flowing into successive grooves, while the fins act as slowing dams. As these grooves are filled, excess slag accumulates on the surface, flares off the end of the jacket, and is carried away in the swirling flow towards the cylindrical walls of primary combustor 14. Because of the flow of water through conduits 84 and 94, the slag at the interface of the heat exchanger is solidified to a substantially solid layer of slag immediately adjacent the metal. On top of that solid layer a second layer of molten and semi-molten slag covers the exterior of jacket 82.

Materials of construction used in the injector/atomizer 54 can be varied, depending upon the application. A general material of construction is stainless steel. However, in the regions where, through cooperation of the cone 64, the coal/water slurry is divided into small channels of flow 66, the preferable material of construction employed is case-hardened steel. Where the coal/-water slurry is caused to undergo a material change in direction, such as at elbows 76, there is employed an erosion resistant material such as "Ferro-tic", an admixture of titanium-carbide particles in a steel matrix. The external manifold shell and surfaces communicating water conduits 68 with water conduits 72 are preferably construction of copper. The entire nozzle can be assembled with a single screw 78, with the use of pins, indents, seals and the like, to achieve proper alignment of the elements of construction. A minimum of sealing surfaces are required to achieve an injector/atomizer which enjoys long-term service under high-temperature conditions and a minimization of erosive wear.

What is claimed is:

1. In a method of combusting pulverized carbonaceous fuel suspended as a slurry in a flow of carrier liquid wherein combustion of the carbonaceous fuel occurs in an elongate combustion zone having a contained tangential and axial flow field of a heated oxidant, the steps of:

(a) flowing said slurry longitudinally of a first conduit extending a substantial distance into the tangential and axial flow field of heated oxidant contained in the combustion zone;

(b) diverting the flow of said slurry into a flow pattern divergent from and at an angle to the direction of longitudinal flow and about a flow diverting bend extending transversely of the longitudinal axis thereof;

(c) intercepting the divergent flow of slurry after passing said bend, with a relatively high velocity flow of atomizing gas flowing through a second conduit annularly surrounding said first conduit, said atomizing gas intercepting and breaking said flow of slurry into minute droplets, and wherein said droplets pass in a divergent pattern into the combustion zone, said droplets being small enough for the carbonaceous fuel to be ignited closely adjacent said conduit.

2. In a method of combusting pulverized carbonaceous fuel suspended as a slurry in a flow of carrier liquid wherein combustion of the carbonaceous fuel occurs in an elongate combustion zone having a contained tangential and axial flow field of a heated oxidant, the steps of:

(a) flowing said slurry longitudinally of a first conduit extending a substantial distance into the tangential and axial flow field of heated oxidant contained in the combustion zone;

(b) forming said slurry into a plurality of filaments originating in the direction of longitudinal flow and about a flow diverting cone and ejecting said plurality of filaments of slurry radially from said first conduit, transversely of the longitudinal axis thereof through a plurality of first slurry ports;

(c) intercepting each of said filaments, exteriorly of said first conduit, with a relatively high velocity flow of atomizing gas flowing through a second conduit annularly surrounding said first conduit, said atomizing gas intercepting each of said filaments, and breaking said filaments into minute droplets and wherein said droplets pass into the combustion zone through a plurality of second slurry ports radially aligned, respectively, with individual ones of said first plurality of slurry ports, said droplets being small enough for the carbonaceous fuel to be ignited closely adjacent said conduit.

3. In a process for combustion of particulate carbonaceous material contained in a slurry wherein combustion of carbonaceous material occurs in an elongate combustor having a contained tangential and axial flow field of a heated oxidant, the improvement comprising:

(a) introducing a flow of slurry into an axially positioned central conduit of a nozzle body axially extending substantially into the contained tangential and axial flow field of heated oxidant in said combustor;

(b) diverting said flow of slurry to axially oriented slurry flow inlet ports of a plurality of slurry flow conduits positioned about a flow diverting cone to first outlet slurry flow ports radially extending from the axis of said nozzle body in a direction substantially normal thereto, each first slurry flow outlet port being in communication with a second radial slurry flow port spaced from the first slurry flow outlet port by an annular space; and (c) introducing a flow of an atomizing gas to the annular space between said first and second slurry flow ports to intersect and atomize the slurry flowing from said first to said second communicating slurry flow ports in a direction normal to slurry flow, while maintaining the slurry in the nozzle below reaction temperature in said oxidant flow field by flow of a coolant through said nozzle body.

4. A process as claimed in claim 3 in which said coolant flows inward to said nozzle through a first conduit, through a manifold, and outward through a second coolantflow conduit.

5. A process as claimed in claim 3 in which the slurry is a slurry of particulate coal in water.

6. A process as claimed in claim 5 in which the coal content of the slurry is at least about 50 percent-by-weight coal.

7. In a process for combustion of particulate carbonaceous material contained in a slurry wherein combustion of carbonaceous material occurs in an elongate combustor having a contained tangential and axial flow field of a heated oxidant, the improvement comprising:

(a) introducing a flow of slurry into an axially positioned central conduit of a nozzle body having a manifold head end axially extending substantially into the tangential and axial flow field of heated oxidant contained in said combustor;

(b) diverting said flow of slurry to axially oriented slurry flow inlet ports of a plurality of slurry flow conduits positioned about a flow diverting cone to first outlet slurry flow ports radially extending from the axis of said nozzle body in a direction substantially normal thereto, each first slurry flow outlet port being in communication with a second radial slurry flow port spaced from the first slurry flow outlet port by an annular space;

(c) introducing a flow of an atomizing gas to the annular space between said first and second slurry flow ports to intersect and atomize the slurry flowing from said first to said second communicating slurry flow ports in a direction normal to slurry flow; and (d) maintaining the slurry in the nozzle below reaction temperature in said oxidant flow field by flow of a coolant inwardly through a plurality of some of conduits axially positioned between said second radial slurry flow ports through said manifold and outwardly of other of said conduits axially positioned between said second radial slurry flow ports.

* * * * *